US007236714B2

(12) United States Patent
Sato et al.

(10) Patent No.: US 7,236,714 B2
(45) Date of Patent: Jun. 26, 2007

(54) POWER SOURCE CONTROL APPARATUS, AND POWER SOURCE CONTROL METHOD

(75) Inventors: Naoki Sato, Kanagawa (JP); Hiroto Ohishi, Kanagawa (JP); Masahide Nakaya, Kanagawa (JP); Keiichi Sugai, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 117 days.

(21) Appl. No.: 11/047,738

(22) Filed: Feb. 2, 2005

(65) Prior Publication Data

US 2005/0232651 A1 Oct. 20, 2005

(30) Foreign Application Priority Data

Feb. 3, 2004 (JP) ..... 2004-026680
Dec. 27, 2004 (JP) ..... 2004-377749

(51) Int. Cl.
*G03G 15/20* (2006.01)
*H05B 1/00* (2006.01)
*H05B 3/00* (2006.01)
*H05B 11/00* (2006.01)

(52) U.S. Cl. ..... 399/70; 399/67; 219/216

(58) Field of Classification Search ..... 399/37, 399/67, 70, 88, 90; 323/318; 219/216
See application file for complete search history.

(56) References Cited

U.S. PATENT DOCUMENTS

2002/0043523 A1* 4/2002 Fujita et al. ..... 219/216

FOREIGN PATENT DOCUMENTS

| | | |
|---|---|---|
| JP | 2000-315567 | 11/2000 |
| JP | 2002-304088 | 10/2002 |
| JP | 2002-357966 | 12/2002 |
| JP | 2003-140484 | 5/2003 |

OTHER PUBLICATIONS

U.S. Appl. No. 11/522,324, filed Sep. 18, 2006, Semma, et al.
U.S. Appl. No. 11/545,512, filed Oct. 11, 2006, Nakaya.
U.S. Appl. No. 11/554,944, filed Oct. 31, 2006, Yano, et al.

* cited by examiner

*Primary Examiner*—Sandra L. Brase

(74) *Attorney, Agent, or Firm*—Oblon, Spivak, McClelland, Maier & Neustadt, P.C.

(57) ABSTRACT

A power source control apparatus including a capacitor; a charge control circuit for controlling a charger that charges the capacitor; a discharging circuit for discharging power charged in the capacitor to a heating member for heating. The power source control apparatus is shifted to an energy saving mode in which power supply to a part of power loads is stopped when a first condition is satisfied, and the power source control apparatus terminates the energy saving mode when a second condition is satisfied. In the apparatus, the charge control circuit is supplied with power from a power source circuit that supplies power during the energy saving mode.

14 Claims, 6 Drawing Sheets

POWER SOURCE CONTROL APPARATUS, AND POWER SOURCE CONTROL METHOD

BACKGROUND OF THE INVENTION

1. Field of the Invention

The present invention relates to a power source control apparatus, a heating apparatus, a fixing apparatus, an image forming apparatus, a power source control method, and a power source control program, and more particularly to such a power source control apparatus, a heating apparatus, a fixing apparatus, an image forming apparatus, a power source control method, and a power source control program, in which a heating member heated by capacitor charged power is provided.

2. Description of the Related Art

A heating member (fixing heater) in a fixing apparatus used for an image forming apparatus, such as an electrophotographic type image forming apparatus preferably requires a rapid supply of electric power. In addition to a power supply from a commercial power source, a chargeable subsidiary power source using an electric double layer condenser, for example, is applied to a heating member of a fixing apparatus used for an electrophotographic type image forming apparatus, as disclosed in Japanese Laid-Open Patent Application Nos. 2000-315567, 2002-357966, and 2003-140484, for providing a technology enabling rapid build up and enhancing energy saving ability.

Some electrophotographic type image forming apparatuses and other electronic apparatuses get into an energy saving mode when they have been not used for a certain period. In the energy saving mode, power supplies are limited to only the minimum circuits to save power and energy, as described in Japanese Laid-Open Patent Application No. 2002-304088.

In the electrophotographic type image forming apparatuses in the above-described documents, a rechargeable subsidiary power source employing a capacitor is used to rapidly raise the temperature of the fixing apparatus. However, when the subsidiary power source is needed to rapidly raise the temperature of the fixing apparatus, its capacitor, if under low power charged situation, cannot rapidly raise the temperature of the fixing apparatus. Then, when the charged power of the capacitor becomes lower than a predetermined value, it is needed for a predetermined control apparatus to control a charger so as to charge the capacitor.

However, in the above mentioned image forming apparatuses, a control device (such as a microcomputer) for controlling the charging of the capacitor is also not supplied with power, and therefore the capacitor cannot be charged during the energy saving mode.

Under this situation, when the capacitor's charged amount is not enough just before shifting to the energy saving mode, or after the energy saving mode lasts too long so as to naturally discharge the capacitor, the capacitor not having enough charged power cannot rapidly raise the fixing temperature of the fixing apparatus.

In prior image forming apparatuses having such an energy saving mode, in a case where the capacitor charged power becomes low enough, the energy saving mode is at once terminated and the apparatus is shifted to the normal mode (image forming mode) to charge the capacitor, and then is returned to the energy saving mode.

However, due to the termination of the energy saving mode for charging purpose, unnecessary power (for example, initial settings such as scanner calibration, etc.) not relating to charging is consumed.

SUMMARY OF THE INVENTION

It is a general object of the present invention to provide a power source control apparatus, a heating apparatus, a fixing apparatus, an image forming apparatus, a power source control method and a power source control program that substantially obviate one or more of the above mentioned problems and can charge a capacitor without terminating an energy saving mode.

Features and advantages of the present invention will be set forth in the description which follows, and in part will become apparent from the description and the accompanying drawings, or may be learned by practice of the invention according to the teachings provided in the description.

One or more objects as well as other features and advantages of the present invention will be realized and attained by a power source control apparatus, a heating apparatus, a fixing apparatus, an image forming apparatus, a power source control method, and a power source control program particularly pointed out in the specification in such full, clear, concise, and exact terms as to enable a person having ordinary skill in the art to practice the invention.

The invention provides a power source control apparatus comprising: a capacitor; a charge control circuit for charge-controlling a charger that charges the capacitor; a discharging circuit for discharging power charged in the capacitor to a heating member for heating; and the power source control apparatus is shifted to an energy saving mode in which power supply to a part of power loads is stopped when a first condition is satisfied, and the power source control apparatus terminates the energy saving mode when a second condition is satisfied; wherein the charge control circuit is supplied with power from a first power source circuit that supplies power during the energy saving mode.

The above power source control apparatus may further comprise: an energy saving control circuit for controlling power during the energy saving mode, the energy saving control circuit being supplied with power from a second power source circuit during the energy saving mode.

In the power source control apparatus, the charge control circuit may receive a capacitor charging voltage signal indicating a charged amount of the capacitor, and the charge control circuit has the charger charge the capacitor when the charged amount is lower than a predetermined amount.

In the power source control apparatus, the charge control circuit may comprise a voltage sensor for detecting a voltage between terminals of the capacitor; a comparator for comparing the detected voltage and a predetermined reference voltage; and a microcomputer for having the charger charge the capacitor when the detected voltage is lower than the reference voltage.

In the power source control apparatus, the reference voltage may be set lower than the fully charged voltage of the capacitor by a predetermined rate.

In the power source control apparatus, the microcomputer may be notified by the voltage sensor of a voltage in accordance with the voltage between terminals of the capacitor, and may estimate a charged amount of the capacitor based on the notified voltage.

In the power source control apparatus, the charger may charge the capacitor during the energy saving mode.

A heating apparatus heated by the above power source control apparatus is also provided.

A fixing apparatus comprising a heating apparatus heated by the above power source control apparatus is also provided.

An image forming apparatus comprising a fixing apparatus heated by the above power source control apparatus is also provided.

A power source control method in a power source control apparatus is also provided, which comprises: a capacitor; a charge control circuit for controlling a charger that charges the capacitor; a discharging circuit for discharging power charged in the capacitor to a heating member for heating; and the power source control apparatus is shifted to an energy saving mode in which power supply to a part of power loads is stopped when a first condition is satisfied, and the power source control apparatus terminates the energy saving mode when a second condition is satisfied; the method comprising the step of: supplying the charge control circuit with power from a first power source circuit that supplies power during the energy saving mode.

A program product is also provided, for controlling the power source in a power source control apparatus comprising: a capacitor; a charge control circuit for controlling a charger that charges the capacitor; a discharging circuit for discharging power charged in the capacitor to a heating member for heating; and the power source control apparatus is shifted to an energy saving mode in which power supply to a part of the power loads is stopped when a first condition is satisfied, and the power source control apparatus terminates the energy saving mode when a second condition is satisfied; the program product executing the procedure that the charge control circuit is supplied with power from a first power source circuit that supplies power during the energy saving mode.

Other objects and further features of the present invention will be apparent from the following detailed description when read in conjunction with the accompanying drawings.

DESCRIPTION OF THE PREFERRED EMBODIMENTS

In the following, embodiments of the present invention are described in detail with reference to the accompanying drawings.

Figure 1:
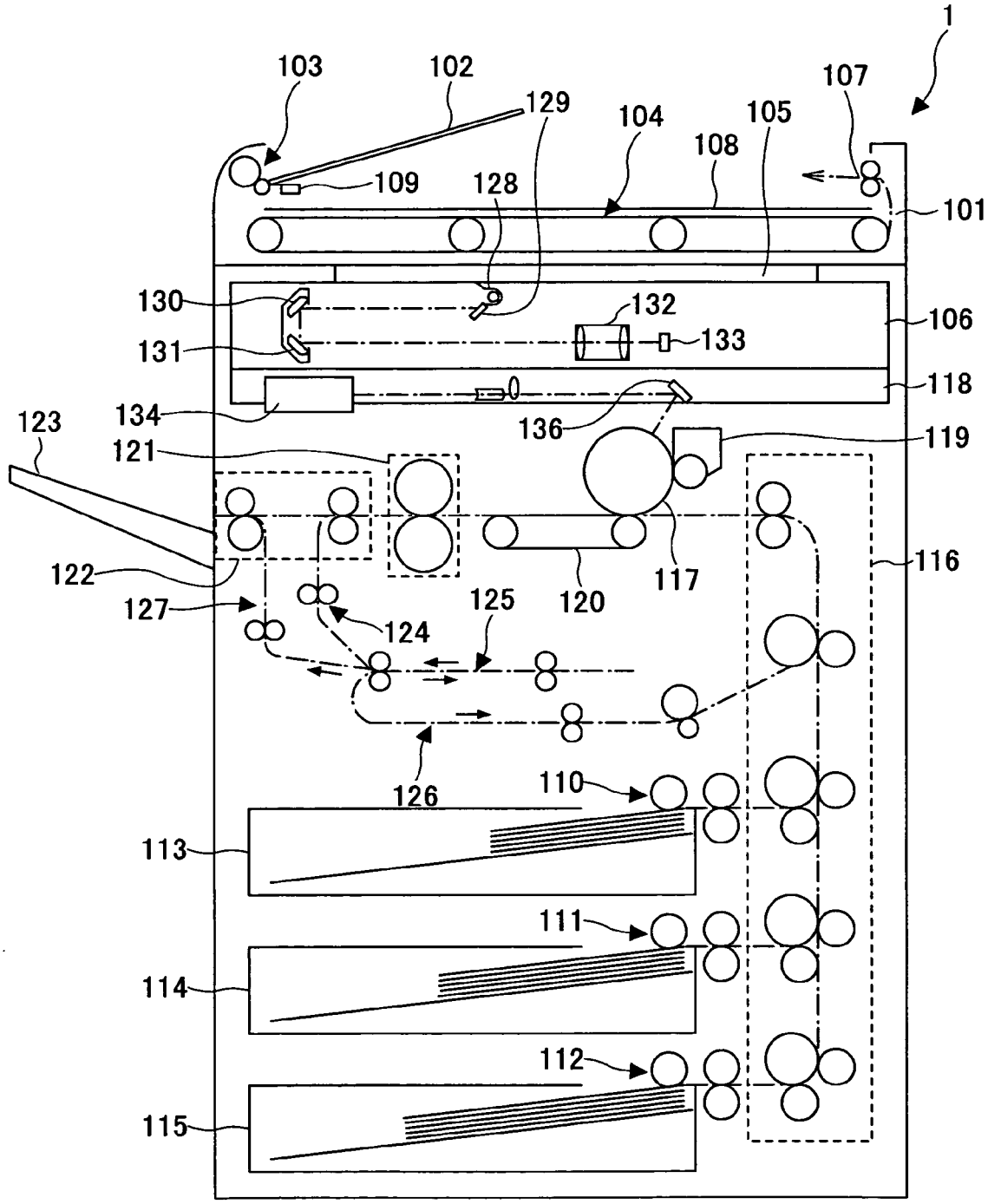
FIG. 1 is a cross-sectional front view of a digital copying apparatus according to an embodiment of the present invention.

FIG. 1 is a cross-sectional front view of a digital copying apparatus 1 according to an embodiment of the present invention. The digital copying apparatus 1, serving as an image forming apparatus of the present invention, is an example of the so-called multiple function processing machine. The digital copying apparatus 1 includes a copy function and other functions (e.g. printer function, facsimile function), in which functions such as the copy function, the printer function and the facsimile function can be sequentially switched and selected by operating an application switching key in an operations part (not shown). Accordingly, the digital copying apparatus 1 can be switched to a copy mode when the copy function is selected, a printer mode when the printer function is selected, and a facsimile mode when the facsimile function is selected.

Next, a configuration of the digital copying apparatus 1 and an operation during the copy mode are described.

In FIG. 1, an original, having its image side facing upward, is placed on an original tray 102 of an automatic document feeding apparatus (hereinafter referred to as "ADF") 101. When a start key of the operations part (not shown) is depressed, the original is fed to a predetermined position on a contact glass 105 by a feeding roller 103 and a conveyor belt 104. The ADF 101 has a counting function for counting the number of originals whenever the feeding of a single original is completed. After the original disposed on the contact glass 105 has its image information read by an image reading apparatus 106, the original is discharged onto a discharge tray 108 by the conveyor belt 104 and a discharge roller 107.

When an original set detector 109 detects the next original placed on the original tray 102, a bottom most original situated on the original tray 102 is, in a likewise manner, fed to a predetermined position on the contact glass 105 by the feeding roller 103 and the conveyor belt 104. Likewise, after the original disposed on the contact-glass 105 has its image information read by the image reading apparatus 106, the original is discharged onto the discharge tray 108 by the conveyor belt 104 and the discharge roller 107. The feeding roller 103, the conveyor belt 104, and the discharge roller 107 are driven by a conveyance motor.

A first feeding apparatus 110, a second feeding apparatus 111, and a third feeding apparatus 112, whenever selected, serve to feed transfer paper stacked thereon. A vertical conveying unit 116 conveys the transfer paper to a position contacting a photoconductor 117. The photoconductor 117 employs, for example, a photoconductor drum, and is rotatably driven by a main motor (not shown).

The image data (image information), which is read from the original by the image reading apparatus 106, is subjected to a predetermined image process by an image processing apparatus (not shown). Then, the image data are converted to optical information by a writing unit 118. The photoconductor 117, after being uniformly charged by an electrifying member (not shown), is exposed with optical information from the writing unit 118 for forming an electrostatic latent image thereon. The electrostatic latent image formed on the photoconductor 117 is developed by a developing apparatus 119, to thereby form a toner image.

It is to be noted that the writing unit 118, the photoconductor 117, the developing apparatus 119, and peripheral apparatuses disposed around the photoconductor 117 are provided to form a printer engine for forming an image onto a medium (e.g., paper) by employing an electro photographic method.

The conveyor belt 120 serves as a sheet-conveying part and also as a transfer part. The conveyor belt 120, being applied with transfer bias from a power source, conveys the transfer sheet from the vertical conveying unit 116 at the same linear rate as the surface of the photoconductor 117, and transfers the toner image from the photoconductor 117 to the transfer sheet. The transfer sheet has the toner image fixed thereto by a fixing apparatus 121 and is discharged to a discharge tray 123 by a discharge unit 122. After the toner image on the photoconductor 117 is transferred, residual toner remaining on the photoconductor 117 is cleaned off by a cleaning apparatus (not shown).

The above-described operation is an operation executed in a normal mode in which an image is copied onto one side of a sheet of paper. In a double-side mode for copying an image(s) onto both sides of a transfer sheet, a transfer sheet, being fed from one of the feeding trays 113-115 and having an image formed on a front side thereof, is directed to a double-side conveying path 124 rather than to the discharge tray 123. Then, a reversing unit 125 switches back the transfer sheet, to thereby reverse the front side and back side of the transfer sheet. Then, the transfer sheet is conveyed to a double-side conveying unit 126.

Then, the transfer sheet, being conveyed to the double-side conveying unit 126, is conveyed to the vertical conveying unit 116 by the double-side conveying unit 126. The vertical conveying unit 116 conveys the transfer sheet to a position contacting the photoconductor 117. Then, a toner formed on the photoconductor 117 is transferred onto the back side of the transfer sheet in a similar manner described above. Finally, a double-sided copy is obtained by fixing the toner image onto the transfer sheet with the fixing apparatus 121. The double-sided copy is discharged to the discharge tray 123 by the discharge unit 122.

In a case of discharging the transfer sheet in a reversed state, the transfer sheet, having its front and back side reversed by the switchback of the reversing unit 125, is discharged to the discharge tray 123 via a reverse discharge conveying path 127 rather than being conveyed to the double-side conveying unit 126.

In a case of the printer mode, image data from the outside rather than the image data from the image processing apparatus are input to the writing unit 118. Then, the operation of forming an image onto a transfer sheet is executed in the same manner described above. In a case of the facsimile mode, the image data read by the image reading apparatus 106 are sent to an opponent from a facsimile transmission part (not shown). Furthermore, image data received from the opponent by the facsimile transmission part rather than the image data from the image processing part are input to the writing unit 118. Then, the operation of forming an image onto a transfer sheet is executed in the same manner described above.

The digital copying apparatus 1 further includes a mass paper supply apparatus (LCT) (not shown), a finisher including, for example, a sorter, a hole-puncher, and a stapler, an operations part for executing, for example, setting of document reading modes and/or a copy scale ratio, setting of finish processes with the finisher, and/or indication to the operator.

Figure 2:
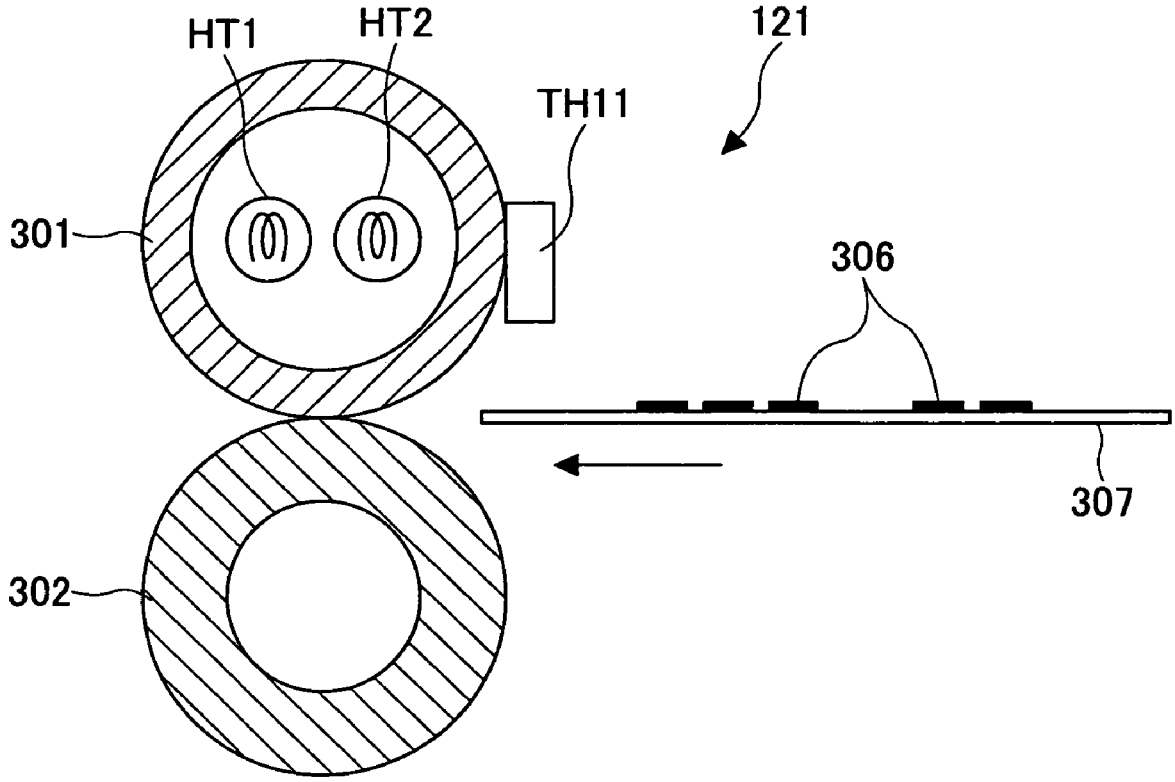
FIG. 2 is a drawing showing an exemplary configuration of a fixing apparatus.

Next, a configuration of the fixing apparatus 121 is described with reference to FIG. 2. The fixing apparatus 121 serves as a heating apparatus and a heating apparatus of the present invention as shown in FIG. 2. In the fixing apparatus 121 shown in FIG. 2, a pressure roller 302, serving as a pressure member formed of an elastic material (e.g., silicone rubber), is abutted with a predetermined pressing force against a fixing roller 301, serving as a fixing member, by a pressure part (not shown). Although the fixing member and the pressure member are typically provided in a roller form, both or either one of the members may be provided in an endless belt form. The fixing apparatus 121 includes heaters HT1 (first heating member) and HT2 (second heating member) which are suitably disposed at prescribed positions. For example, the heaters HT1 and HT2 are disposed inside the fixing roller 301 for heating the fixing roller (i.e. fixing member) 301 from the inside.

The fixing roller 301 and the pressure roller 302 are rotatably driven by a driving mechanism (not shown). A temperature sensor (e.g. a thermistor) TH11 abuts the surface of the fixing roller 301 and detects the surface temperature (fixing temperature) of the fixing roller 301. A sheet 307 (e.g. transfer paper), serving as a medium carrying toner 306 thereon, is passed through a nipping portion between the fixing roller 301 and the pressure roller 302, to thereby have a toner image fixed thereto by the heat and pressure applied from the fixing roller 301 and the pressure roller 302.

The fixing heater HT1 (first heating member) is switched ON when the temperature of the fixing roller 301 has not reach a target temperature Tt as a reference temperature for the fixing roller 301, and then the fixing heater HT1 serves as a main heater for mainly heating the fixing roller 301. The fixing heater HT2 (second heating member) is a subsidiary heater for subsidiarily heating the fixing roller 301. The fixing heater HT2 is switched ON upon a warm-up time of the fixing apparatus 121 (e.g., during the actuation of the main power source of the digital copying apparatus 1, or during a buildup time upon shifting from an energy saving off-mode to a copy-ready state) or a time when the temperature of the fixing roller 301 has not reached a target temperature during an image forming operation.

Figure 3:
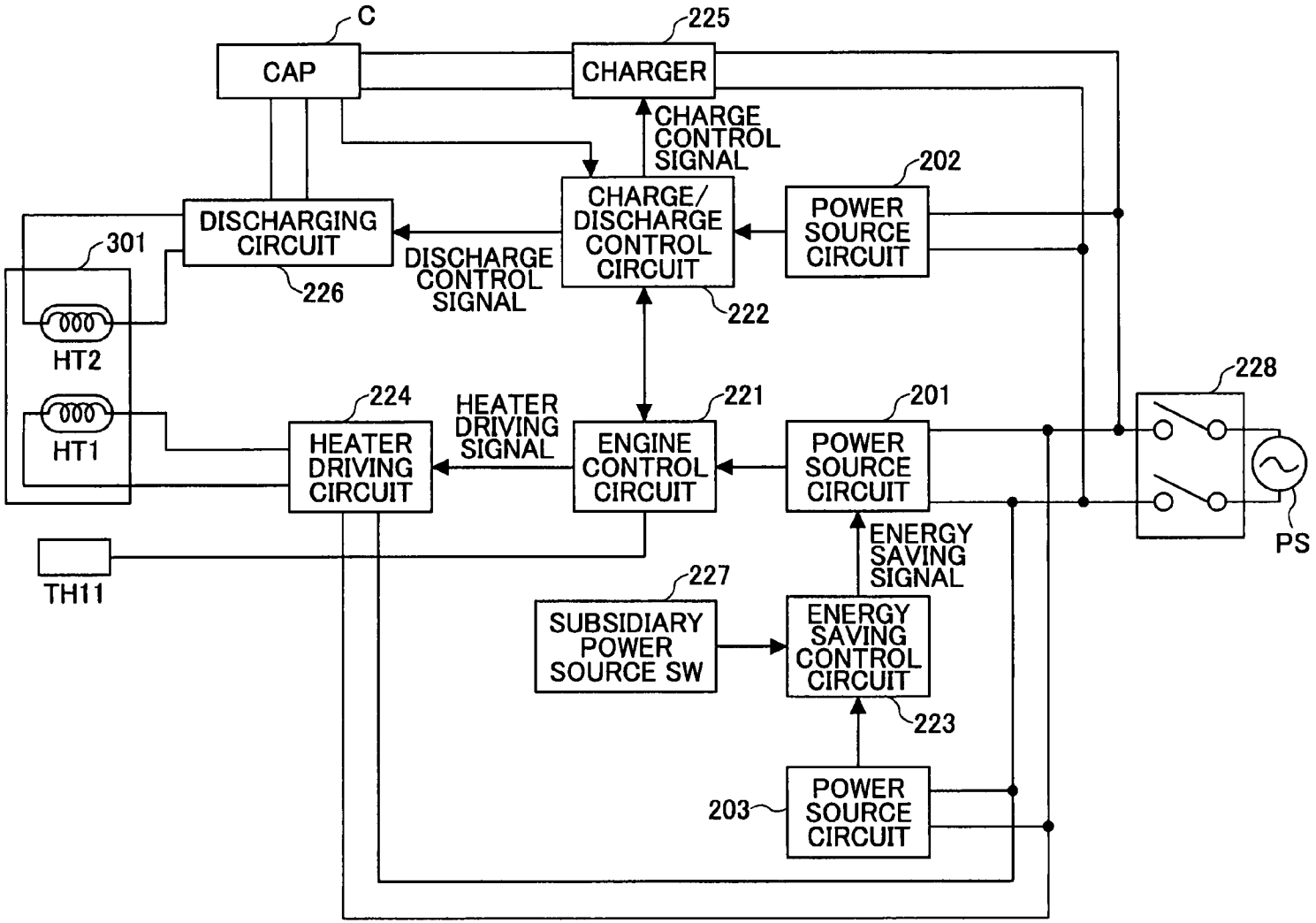
FIG. 3 is a circuit diagram showing a power source control circuit of a digital copying apparatus including a fixing apparatus.

FIG. 3 is a circuit diagram showing an exemplary configuration of a power source control system of the digital copying apparatus 1 including the fixing apparatus 121. The power source control system shown in FIG. 3 includes a main power source switch SW228 for switching on/off the supply of an AC power source (commercial alternating current supply) PS. When the main power source switch SW228 is turned ON, power source circuits 201, 202 and 203 receive power supplied from the AC power source PS and generate power necessary for controlling apparatuses such as the fixing apparatus 121. For example, the power source circuit 201 supplies power to an engine control circuit 221 including the fixing apparatus 121. The power source circuit 202 supplies power to a charge/discharge control circuit 222. The power source circuit 203 supplies power to an energy saving control circuit 223.

The engine control circuit 221 has a microcomputer to heat the whole of the printer engine (including the fixing apparatus 121) of the digital copying apparatus 1. A heater driving circuit 224 receives power from the AC power source PS, and supplies electric current to the fixing heater HT1. The current supply to the fixing heater HT1 is controlled by a heater driving signal output from the engine control circuit 221. Under this control, the fixing heater HT1 is ON and heats the fixing roller 301 when the temperature of the fixing roller 301 has not reached the target temperature Tt (the temperature of the fixing roller 301 is detected by the temperature sensor TH11).

A capacitor C that may be an electric dual layer capacitor is charged by a charger 225, which is supplied with power by the AC power source PS. A discharging circuit 226 as a discharger discharges the charged power of the capacitor C to supply power to and heat the fixing heater HT2. The capacitor C outputs a capacitor charging voltage signal to the charge/discharge control circuit 222. The charger 225 and discharging circuit 226 are controlled by a charge control signal and discharge control signal output by the charge/discharge control circuit 222. Under this control, the fixing heater HT2 is supplied with power during a warm-up time of the fixing apparatus 121 (e.g., during the actuation of the main power source of the digital copying apparatus 1, or during a buildup time upon shifting from an energy saving off-mode to a copy-ready state).

The energy saving control circuit 223 has a microcomputer to control the energy saving mode of the printer engine (including the fixing apparatus 121) and other loads in the digital copying apparatus 1. Under a predetermined condition, for example when the main power source SW228 is ON and non-use time (for not forming images) of the copy apparatus 1 continues longer than a predetermined period, or when a user turns ON the subsidiary power source SW227, power supply is stopped (energy saving mode) to all power loads (such as scanner portion) required for forming images, except a part of the power loads.

Under this stoppage status and some additional predetermined condition, the above mentioned power supply stoppage is terminated (return to normal mode), for example, when a user touches an operations panel (not shown) for operating the digital copying apparatus 2. The power source circuit 201 supplies power to almost of all power loads such as the printer engine including the fixing apparatus 121, not only to the engine control circuit 221. When the power source circuit 201 receives an energy saving signal from the energy saving control circuit 223, the power source circuit 201 stops the power supply to the engine control circuit 221 and the heater driving circuit 224.

At this time, the power source circuit 202, the power source circuit 203, the charge/discharge control circuit 222, the energy saving control circuit 223, the charger 225 and the subsidiary power source SW227 are supplied power. When the power source circuit 201 does not received an energy saving signal, the power source circuit 201 resumes the power supply to the engine control circuit 221, the heater driving circuit 224 and others.

Even during the energy saving mode where the power source circuit 201 is OFF, the energy saving control circuit 223 can receive power from the power source circuit 203, independently from the power source circuit 201. Therefore, there is no problem in reviving the power source circuit 201 from the energy saving mode.

Figure 4:
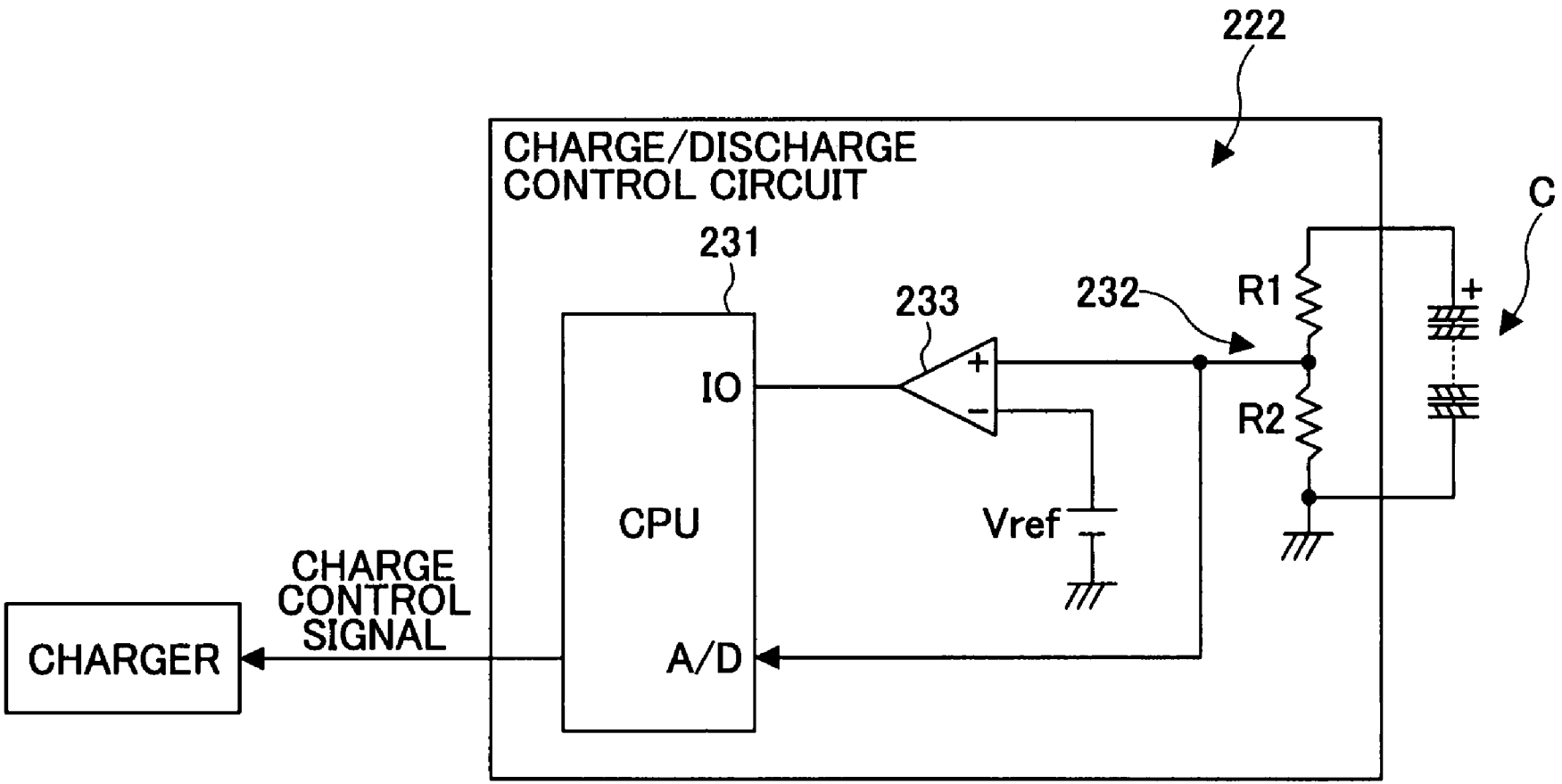
FIG. 4 is a circuit diagram showing an exemplary configuration of a charge/discharge control circuit.

And even during the energy saving mode where the power source circuit 201 is OFF, the charge/discharge control circuit 222 can receive power from the power source circuit 202, independently from the power source circuit 201. Therefore, even during the energy saving mode, the charge/discharge control circuit 222 can receive charge/discharge voltage signals from the capacitor C. Accordingly, the charge/discharge control circuit 222 can perform charging of the capacitor C by a mechanism as shown in FIG. 4.

A configuration and operation of the charge/discharge control circuit 222 is explained below. FIG. 4 is a circuit diagram of the charge/discharge control circuit 222. As shown in FIG. 4, the charge/discharge control circuit 222 has a microcomputer 231. Both terminals of capacitor C are connected by resistances R1 and R2, which resistances are connected in series at a node where a voltage sensor 232 is provided to detect a divided voltage.

A detected signal output by the voltage sensor 232 is compared with a predetermined reference voltage Vref. When the detected signal is-lower than the reference voltage Vref, the comparator 233 outputs a trigger signal (L level signal of the comparator 233) to the microcomputer 231 to have it start charging the capacitor C. In response to the trigger signal input from the comparator 233, the microcomputer 231 starts charging the capacitor C. During the charging, the microcomputer 231 sends the charge control signal to the charger 225.

The comparator 233 determines if charging is necessary or not, based on the reference voltage Vref and the voltage divided by the resistances R1 and R2. When it is determined that charging is necessary, the microcomputer 231 converts the analog voltage divided by the resistances R1 and R2 to a digital value. The microcomputer 231 estimates the present charged amount based on the digital voltage value. Based on the trigger signal (IO) input from the comparator 233 and the digital voltage value, the microcomputer 231 outputs a charge control signal to a charger 225 to start charging the capacitor C.

Figure 5A:
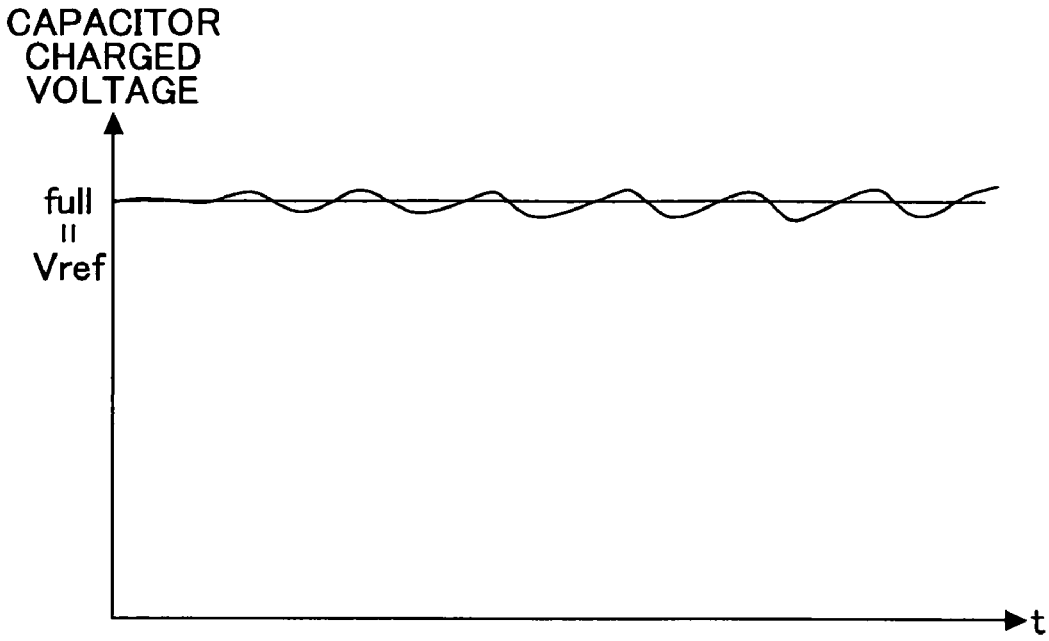
FIGS. 5A and 5B are charts showing a capacitor charged voltage and a reference voltage.
Figure 5B:
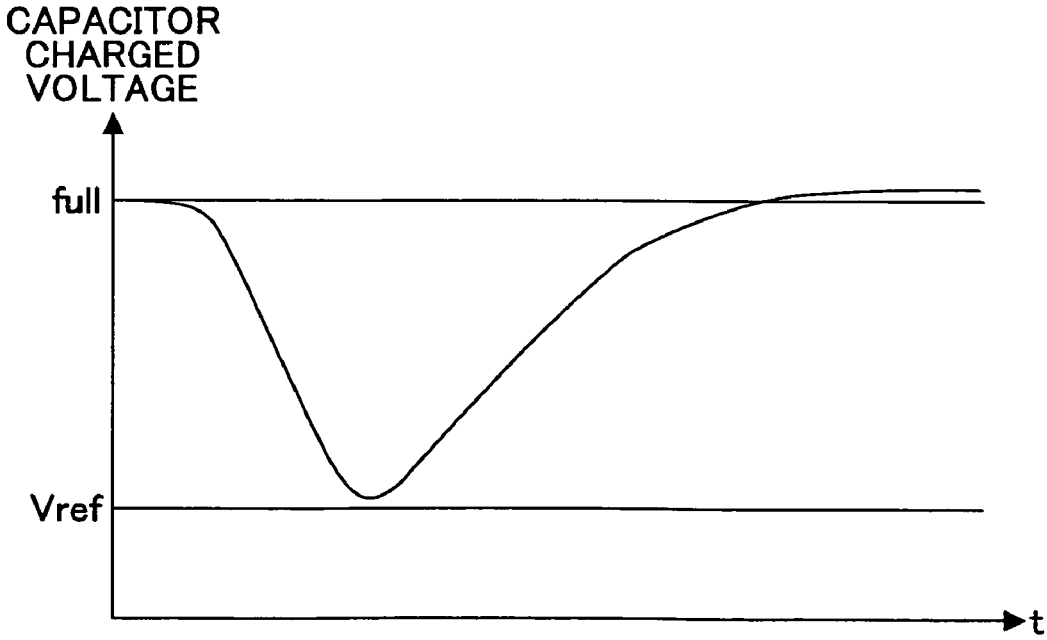

The reference voltage Vref is set at a value (42V) that is a little bit lower than the full charged voltage (for example, 45V) of the capacitor C, because of the following reason. If the reference voltage Vref is set at the same value as the full charged voltage, even after the constant current charging is completed, the voltage of the capacitor is lowered by (the constant current)×(capacitor internal resistance), and therefore the charged voltage oscillates as shown in FIG. 5A. By setting the reference voltage Vref at a voltage that is a little bit lower than the full charged voltage as shown in FIG. 5B, the oscillation can be avoided and tolerances of parts of the charge/discharge control circuit 222 can be compensated for when charge controlling.

Controlling the operations procedure carried out by the charge/discharge control circuit 222 is explained below.

FIGS. 6A-6D are timing charts illustrating the operation of the microcomputer 231. The charge/discharge control circuit 222 can received power from the power source circuit 202 that is independent from the power source circuit 201 used in the normal mode.

Figure 6:
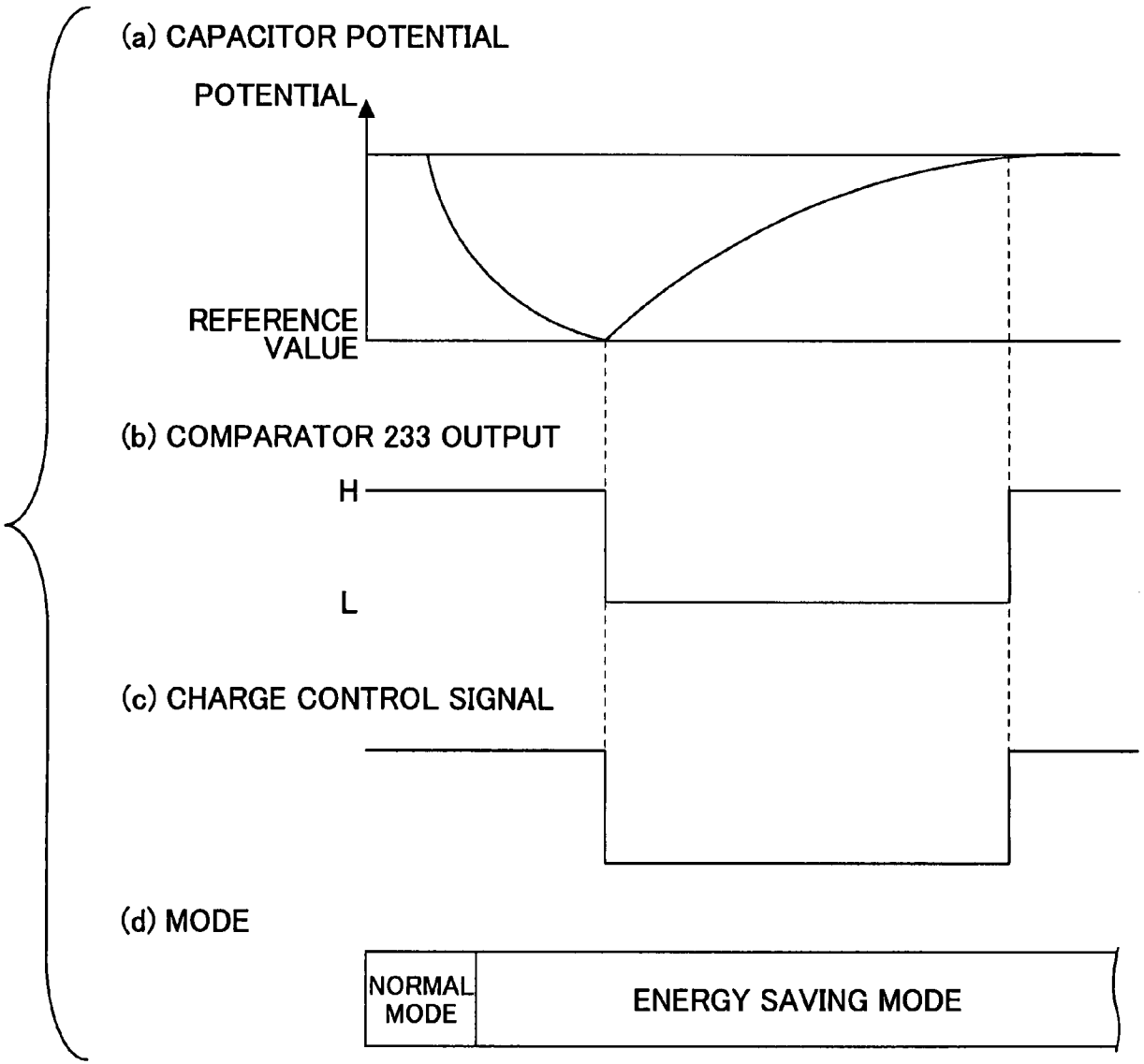
FIGS. 6A-D are timing charts illustrating operation of the charge/discharge control circuit.

While the microcomputer 231 is in the energy saving mode, if a voltage between terminals of the capacitor C becomes lower than the reference voltage (Vref) as shown in FIG. 6A, the output signal from the comparator 233 changes from H level to L level as shown in FIG. 6B. Taking the change of the output signal from the comparator 233 from H level to L level as a trigger, the microcomputer 231 has the charger 225 start charging the capacitor C, while maintaining the energy saving mode. During the charging of the capacitor, the microcomputer 231 outputs charge control signals as shown in FIG. 6C to the charger 225. FIG. 6D shows the timing when the normal mode is changed to the energy saving mode.

In this manner, the charge/discharge control circuit 222 can charge the capacitor when its voltage between terminals is lowered as mentioned above, even during the energy saving mode. Accordingly the capacitor C can supply enough power to the fixing heater HT2 to quickly heat the fixing roller 301, even immediately after recovering from the energy saving mode. Since the capacitor C can be charged while maintaining the energy saving mode, the digital copying apparatus 1 according to the embodiment of the present invention can reduce power consumption, compared with operations where the capacitor is charged after recovering from the energy saving mode to the normal mode.

By the way, in image forming apparatuses such as digital copying apparatuses placed in ordinary offices, the period of the energy saving mode where images are not formed is significantly longer than the period of the normal mode where images are formed. For example, data show that in such digital copying apparatuses placed in ordinary offices, the period of the energy saving mode occupies about 90% of the total service period.

Accordingly, when a digital copying apparatus is ordinarily used, charging the capacitor C is completed during the energy saving mode. Therefore, when the energy saving mode is terminated, the charged power in the capacitor C can be freely used without worrying about the charge amount of the capacitor C.

In the above mentioned embodiment, power is supplied to the charge/discharge control circuit 222 even during the energy saving mode. On the other hand, the charge/discharge control circuit 222 can have a sleep mode, and L level signal output from the comparator 233 can be utilized as a wake-up signal to the charge/discharge control circuit 222. In this manner, further energy saving is accomplished.

As explained above, according to the embodiment of the present invention, the capacitor C can be charged without terminating the energy saving mode. When predetermined conditions are satisfied, power supply is stopped (for example, an energy saving mode) to power loads of the digital copying apparatus 1 except a part of the power loads. Since power being supplied to the charge/discharge control circuit 222 is independent from the power source circuit 201 that is used in the normal mode, the capacitor C can be charged while maintaining the energy saving mode.

According to the embodiment of the present invention, it is not required to change from the energy saving mode to the normal mode in order to charge. Therefore, a conventional mechanism is no longer required, in which operation of circuits (for example, a scanner circuit, hard disk circuit, etc.) other than a charging circuit is stopped by software during the normal mode.

The present invention is not limited to these embodiments, but various variations and modifications may be made without departing from the scope of the present invention described in claims. For example, in FIG. 3, the power source circuit 203 supplying power to the energy saving control circuit 223 is different from the power source circuit 202 supplying power to the charge/discharge control circuit 222. They may be the same power source circuit. The charge/discharge control circuit 222 may be charged by the power source circuit 203 during the energy saving mode.

The present application is based on Japanese Priority Application Nos. 2004-026680 and 2004-377749 filed on Feb. 3, 2004, and Dec. 27, 2004, respectively, with the Japanese Patent Office, the entire contents of which are hereby incorporated by reference.

What is claimed is:

1. A power source control apparatus, comprising:

a capacitor;

a charge control circuit for controlling a charger that charges the capacitor;

a discharging circuit for discharging power charged in the capacitor to a heating member for heating; and an energy saving control circuit for controlling power during an energy saving mode, the energy saving control circuit being supplied with power from a second power source circuit during the energy saving mode, so that the charger charges the capacitor during the energy saving mode;

wherein the power source control apparatus is shifted to the energy saving mode in which power supply to a part of power loads is stopped when a first condition is satisfied, and the power source control apparatus terminates the energy saving mode when a second condition is satisfied; and wherein the charge control circuit is supplied with power from a first power source circuit that supplies power during the energy saving mode.

2. The power source control apparatus as claimed in claim 1, wherein the charge control circuit receives a capacitor charging voltage signal indicating a charged amount of the capacitor, and the charge control circuit has the charger charge the capacitor when the charged amount is lower than a predetermined amount.

3. The power source control apparatus as claimed in claim 1, wherein the charge control circuit includes:

a voltage sensor for detecting a voltage between terminals of the capacitor;

a comparator for comparing the detected voltage and a predetermined reference voltage; and a microcomputer for having the charger charge the capacitor when the detected voltage is lower than the reference voltage.

4. The power source control apparatus as claimed in claim 3, wherein the reference voltage is set lower than the fully charged voltage of the capacitor by a predetermined rate.

5. The power source control apparatus as claimed in claim 3, wherein the microcomputer is notified by the voltage sensor of a voltage in accordance with the voltage between terminals of the capacitor, and estimates a charged amount of the capacitor based on the notified voltage.

6. A heating apparatus heated by the power source control apparatus as claimed in claim 1.

7. A fixing apparatus comprising:

a heating apparatus heated by the power source control apparatus as claimed in claim 1.

8. An image forming apparatus comprising:

a fixing apparatus heated by the power source control apparatus as claimed in claim 1.

9. A power source control method in a power source control apparatus that includes a capacitor;

a charge control circuit for controlling a charger that charges the capacitor; and a discharging circuit for discharging power charged in the capacitor to a heating member for heating;

the power source control apparatus being shifted to an energy saving mode in which power supply to a part of power loads is stopped when a first condition is satisfied, the power source control apparatus terminating the energy saving mode when a second condition is satisfied;

the method comprising:

supplying the charge control circuit with power from a first power source circuit that supplies power during the energy saving mode; and supplying an energy saving control circuit for controlling power during the energy saving mode with power from a second power source circuit during the energy saving mode so that the capacitor is charged during the energy saving mode.

10. The power source control method as claimed in claim 9, further comprising the steps of:

the charge control circuit receiving a capacitor charging voltage signal indicating a charged amount of the capacitor; and the charge control circuit having the charger charge the capacitor when the charged amount is lower than a predetermined amount.

11. The power source control method as claimed in claim 9, further comprising the steps of:

the charge control circuit detecting a voltage between terminals of the capacitor;

comparing the detected voltage and a predetermined reference voltage; and having the charger charge the capacitor when the detected voltage is lower than the reference voltage.

12. The power source control method as claimed in claim 11, wherein the reference voltage is set lower than the fully charged voltage of the capacitor by a predetermined rate.

13. The power source control method as claimed in claim 11, further comprising the steps of:

the microcomputer being notified by the voltage sensor of a voltage in accordance with the voltage between terminals of the capacitor, and estimating a charged amount of the capacitor based on the notified voltage.

14. A program product for controlling a power source in a power source control apparatus that includes a capacitor;

a charge control circuit for controlling a charger that charges the capacitor;

a discharging circuit for discharging power charged in the capacitor to a heating member for heating; and an energy saving control circuit for controlling power during an energy saving mode, the energy saving control circuit being supplied with power from a second power source circuit during the energy saving mode, so that the charger charges the capacitor during the energy saving mode;

the power source control apparatus being shifted to an energy saving mode in which power supply to a part of power loads is stopped when a first condition is satisfied, the power source control apparatus terminating the energy saving mode when a second condition is satisfied;

the program product for executing a procedure of supplying the charge control circuit with power from a first power source circuit that supplies power during the energy saving mode.

* * * * *